US006044765A

United States Patent [19]

Regebro

[11] Patent Number: 6,044,765

[45] Date of Patent: Apr. 4, 2000

[54] METHOD FOR INCREASING THE PROBABILITY OF IMPACT WHEN COMBATING AIRBORNE TARGETS, AND A WEAPON DESIGNED IN ACCORDANCE WITH THIS METHOD

[75] Inventor: Chirster Regebro, Eskilstuna, Sweden

[73] Assignee: Bofors AB, Karlskoga, Sweden

[21] Appl. No.: 09/043,852

[22] PCT Filed: Oct. 4, 1996

[86] PCT No.: PCT/SE96/01257

§ 371 Date: Jun. 23, 1998

§ 102(e) Date: Jun. 23, 1998

[87] PCT Pub. No.: WO97/13116

PCT Pub. Date: Apr. 10, 1997

[30] Foreign Application Priority Data

Oct. 5, 1995 [SE] Sweden ..... 9503447

[51] Int. Cl.[7] ..... F42C 13/02

[52] U.S. Cl. ..... 102/213; 102/211; 102/475; 102/492; 102/494

[58] Field of Search ..... 102/213, 211, 102/214, 491, 492, 496, 494, 497, 475

[56] References Cited

U.S. PATENT DOCUMENTS

| | | | |
|---|---|---|---|
| 3,136,251 | 6/1964 | Witow | 102/491 |
| 3,565,009 | 2/1971 | Allred et al. . | |
| 3,962,972 | 6/1976 | Skagerlund et al. | 102/213 |
| 4,174,665 | 11/1979 | Madlener | 102/496 |
| 4,303,015 | 12/1981 | Bourlet | 102/492 |
| 4,524,696 | 6/1985 | Altenau et al. | 102/491 |
| 4,612,859 | 9/1986 | Furch et al. | 102/491 |
| 4,655,139 | 4/1987 | Wilhelm | 109/494 |
| 4,848,236 | 7/1989 | Hembire | 102/213 |
| 4,882,996 | 11/1989 | Bock et al. | 102/496 |
| 4,896,606 | 1/1990 | De Coi | 102/213 |
| 4,936,216 | 6/1990 | Skagerlund | 102/213 |
| 4,982,668 | 1/1991 | Bender et al. | 102/496 |
| 5,003,885 | 4/1991 | Rudolf et al. | 102/494 |
| 5,014,621 | 5/1991 | Fox et al. | 102/213 |
| 5,196,645 | 3/1993 | Wisshaupt | 102/213 |
| 5,229,542 | 7/1993 | Bryan et al. | 102/491 |
| 5,261,629 | 11/1993 | Becker et al. | 102/213 |
| 5,668,346 | 9/1997 | Kunz et al. | 102/211 |

*Primary Examiner*—Harold J. Tudor

*Attorney, Agent, or Firm*—Pollock, Vande Sande & Amernick

[57] ABSTRACT

The present invention relates to a method and a device for combating aircraft (4). According to the invention, use is made of a projectile which rotates in the trajectory (5) towards the target (4) and which is provided with a direction-sensing proximity fuse whose direction of impact has been coordinated with a defined splinter-scattering direction for the explosive charge (8) of the projectile. In a preferred embodiment, the projectile concerned is a projectile which is fired by means of rocket technology, backblast technology or, alternatively, by means of a gas generator, and which is included in a one-man weapon or team-operated weapon of the single-shot type.

27 Claims, 2 Drawing Sheets

METHOD FOR INCREASING THE PROBABILITY OF IMPACT WHEN COMBATING AIRBORNE TARGETS, AND A WEAPON DESIGNED IN ACCORDANCE WITH THIS METHOD

FIELD OF THE INVENTION

The present invention relates to a novel method, and to a projectile designed in accordance therewith, for increasing the probability of target impact when combating airborne targets by means of a projectile which is filled with explosive, is fired towards the target, rotates in its trajectory, and creates splinters upon detonation, which is initiated when the target is indicated by a proximity fuse.

The method and the projectile in accordance with the invention are conceived for use in connection with weapons which, because they are not equipped with advanced sighting and tracking systems adapted for combating aircraft, depend to a particularly large extent on exerting an impact on the target even in the event of serious misses, for example of up to 10 to 100 meters.

BACKGROUND OF THE INVENTION

Developments in the field of aviation, both in the form of conventional aircraft, attack helicopters and anti-tank helicopters, and guided and self-piloting missiles, have increased the requirements of even quite small military units for simple and effective anti-aircraft weapons; requirements which the air defence equipment available at present will never be able to satisfy completely. This is particularly so because the enhanced airborne capabilities have been forcing the established anti-aircraft systems to become ever more sophisticated, and therefore expensive, if they are to have any possibility of combating the enemy aircraft under all circumstances.

As has already been indicated, the present invention is intended to be used in relatively simple weapon systems and in those which for some other reason do not have sighting and tracking equipment adapted for combating airborne targets. For example, the present invention intended for use with guns intended for other main purposes, for instance tank guns. Alternatively, the invention is intended for use with relatively simple one-man weapons or team-operated weapons intended for direct anti-aircraft combat, for example of the back-blast, countermass or rocket type. What may be regarded as a common feature of these types of weapons is the fact that they are principally employed in rapidly developing self-defense situations against more or less direct attacks from aircraft. In these circumstances, both the absence of appropriately advanced sighting equipment and the lack of time for preparation impose extra high demands on the range of impact of the weapon in the event of near misses.

Thus, in order to achieve the result which is sought in connection with the invention, what is needed is, on the one hand, a warhead with a sufficient impact range. On the other hand, a proximity fuse for firing the impact component with sufficiently active range is needed. Also needed is a search system adapted for the purpose of identifying actual targets and eliminating any error indications. In addition, there is of course the system carrier or the actual projectile. In a preferred embodiment, this can consist of an autonomous projectile fired, using rocket or back-blast technology for example, from a launch barrel of the single-shot type. Such a weapon would be an inexpensive and efficient weapon for the infantry, for example, for defence against low-flying aircraft.

The generation of proximity fuses which are today in active service, primarily in anti-aircraft guns and missiles, are Doppler radar type with omni-directional search beams. Also at least near ground level, the fuses have short feasible ranges of 2 to 5 meters, for example. These proximity fuses do not give any directional information with respect to the indicated target, but simply indicate the proximity to a possible target. Since the present-day impact components are also designed so that they scatter their splinters radially upon detonation of their explosive charge, the inability of the proximity fuse to define the direction to the target has not represented any disadvantage, other than the fact that both the proximity fuse and the active charge squander some of their inherent energy in the direction away from the target.

SUMMARY OF THE INVENTION

In accordance with the present invention, it is now proposed instead that both the proximity fuse and active charge be made direction-dependent. This is entirely feasible if starting from the point of the basic presently advailable knowledge. In this connection, it would be possible for both the range of the proximity fuse and the impact range of the impact component to be increased very considerably. These goals could be accomplished without the energy supply to either the fuse or impact component needing to be increased. Instead, the energy supply merely needs to be concentrated in one or more active directions. The possibility of being able to cover the area around the projectile trajectory using a weapon constructed in accordance with this basic principle does, of course, already exist for any projectile which rotates in its trajectory.

Calculations have shown that the range for a warhead designed in accordance with the present invention, that is to say the range of both the proximity fuse and of the active charge, could be increased, using these basic principles, by a factor of 10 compared with an impact component of equal size and of an earlier and now conventional construction. It is undeniable that this could be of very great value.

Another advantage of a direction-sensing proximity fuse of the type characterizing the invention is that it should be entirely possible, with its help, to obviate the problems which today's proximity fuses give rise to on account of the fact that they have a tendency, because of the form of their antenna pattern, ti trigger the explosive charges of the warheads too late around the outer limit of their range, that is to say only after the projectile has passed the target.

The advantages afforded by the present invention also include the fact that a considerable increase in capability should be possible, even in the case of the fully modern anti-aircraft gun, if the principles of the invention are applied thereto.

The present invention could thus be defined in the first instance as a method, and in the second instance as a device. The method and device are for combating airborne targets by means of a projectile which is charged with explosive and provided with a proximity fuse. The projectile is fired in a trajectory towards the target rotates about its own longitudinal axis. When a target is indicated by the proximity fuse, the projectile is initiated to detonate and on detonation scatters splinters in the direction towards the target. The characteristic feature of the invention is that the proximity fuse included in the projectile is given at least one, but no more than four, search direction(s). The search direction(s) is (are) limited narrowly to the sides and oriented at an angle of 15–90° to the trajectory direction of the projectile. At the same time, the splinter-forming shell of the projectile is designed such that its dynamic splinter directions, created upon detonation of the explosive, completely cover possible contacts of the proximity fuse with targets within its own range, but independently of the distance to the projectile trajectory.

The search direction or search directions of the proximity fuse will be coordinated with the dynamic splinter-scattering direction or splinter-scattering directions of the actual projectile. In this context, it is, of course, necessary to take into consideration both the velocity of the projectile and its speed of rotation, and also the reaction time of the initiation system cooperating with the proximity fuse.

In accordance with the basic principles described herein, the proximity fuse can then be designed with two search arms which lie extremely close to one another and are otherwise identical (for example, diverging by only one degree or a few degrees). With this basic construction, it is in fact easy to eliminate a large number of different error indications, since two completely different indications, that is with differences greater than a defined limit value, for both the search arms can very probably be regarded as meaning that one search arm has struck a target while the other lies outside. By contrast, two identical indications which are not changed within a predetermined sequence can very probably be regarded as signifying ground contact, water or, under certain conditions, clouds.

BRIEF DESCRIPTION OF THE DRAWINGS

The various features of the invention are defined in the attached claims, and the invention will now be described in somewhat greater detail with reference to the attached figures, of which:

FIG. 1 thus shows a marksman 1 equipped with a weapon 2 which is designed in accordance with the invention. The weapon consists of a launch barrel and a projectile 3 launched from this barrel by means of a gas generator or in some other way. The main parts of the projectile 3 are shown in FIG. 2. The marksman 1 in FIG. 1 is under threat from an attack helicopter 4, against which he has therefore fired his weapon. The projectile 3 follows the trajectory 5, shown in the figure, in the direction towards the target. While the projectile is flying on the trajectory 5, a proximity fuse 6 (see FIG. 2), which is incorporated in the projectile, successively searches, via a narrowly limited search beam moving along a helical track defined by the rotation of the projectile, the surrounding area out to and including the maximum range of the proximity fuse. In the figures, this search beam is intentionally shown only as individual dashed lines 7. The intention is in fact that these will have a lateral extent which is as small as is technically possible. The area around the projectile trajectory scanned by the proximity fuse is indicated in FIG. 1 in the form of a spiral line 7', which thus symbolizes the longest range of the proximity fuse. When the proximity fuse 6 has indicated the target 4, the active charge 8 of the projectile is detonated, whereupon a hail of splinters fired in the direction of the site of the target indication is formed.

Figure 1:
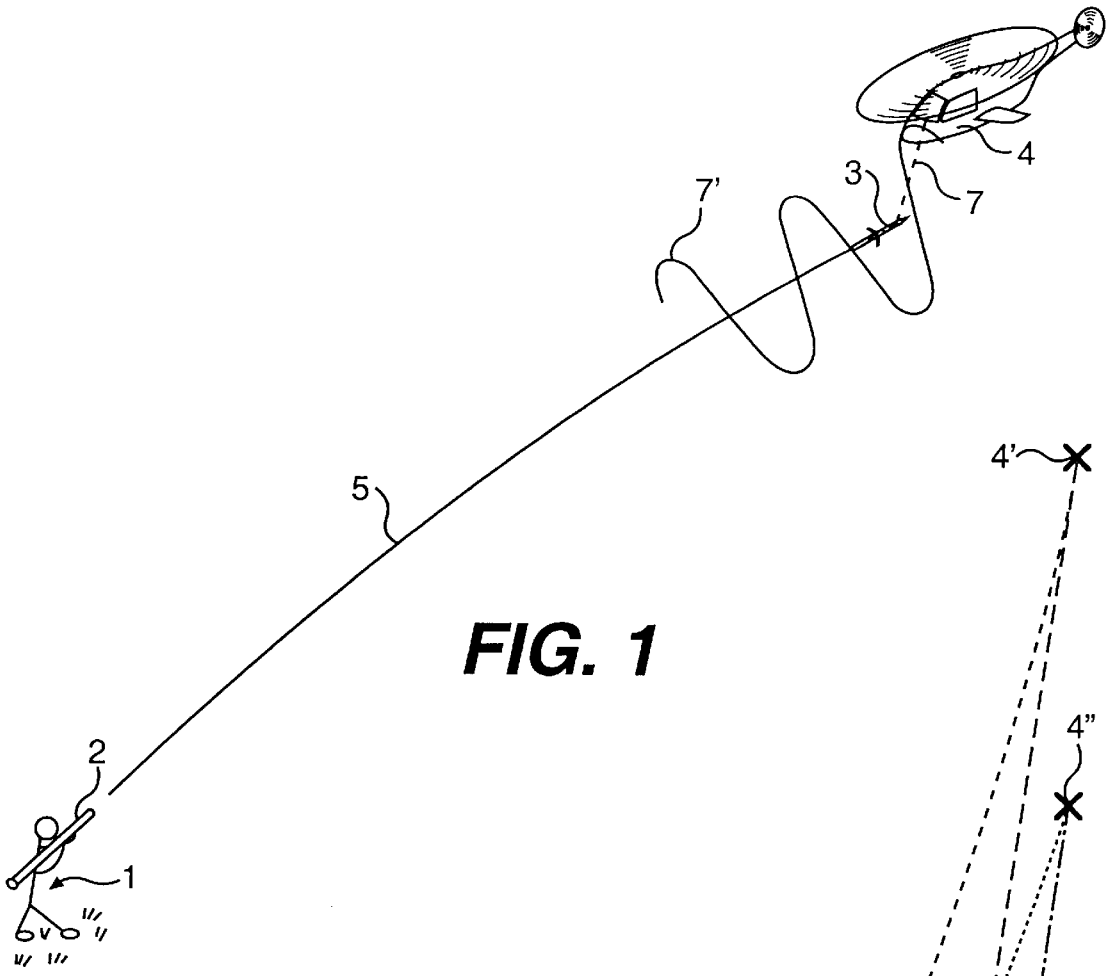
FIG. 1 shows a sketch of an example of use.
Figure 2:
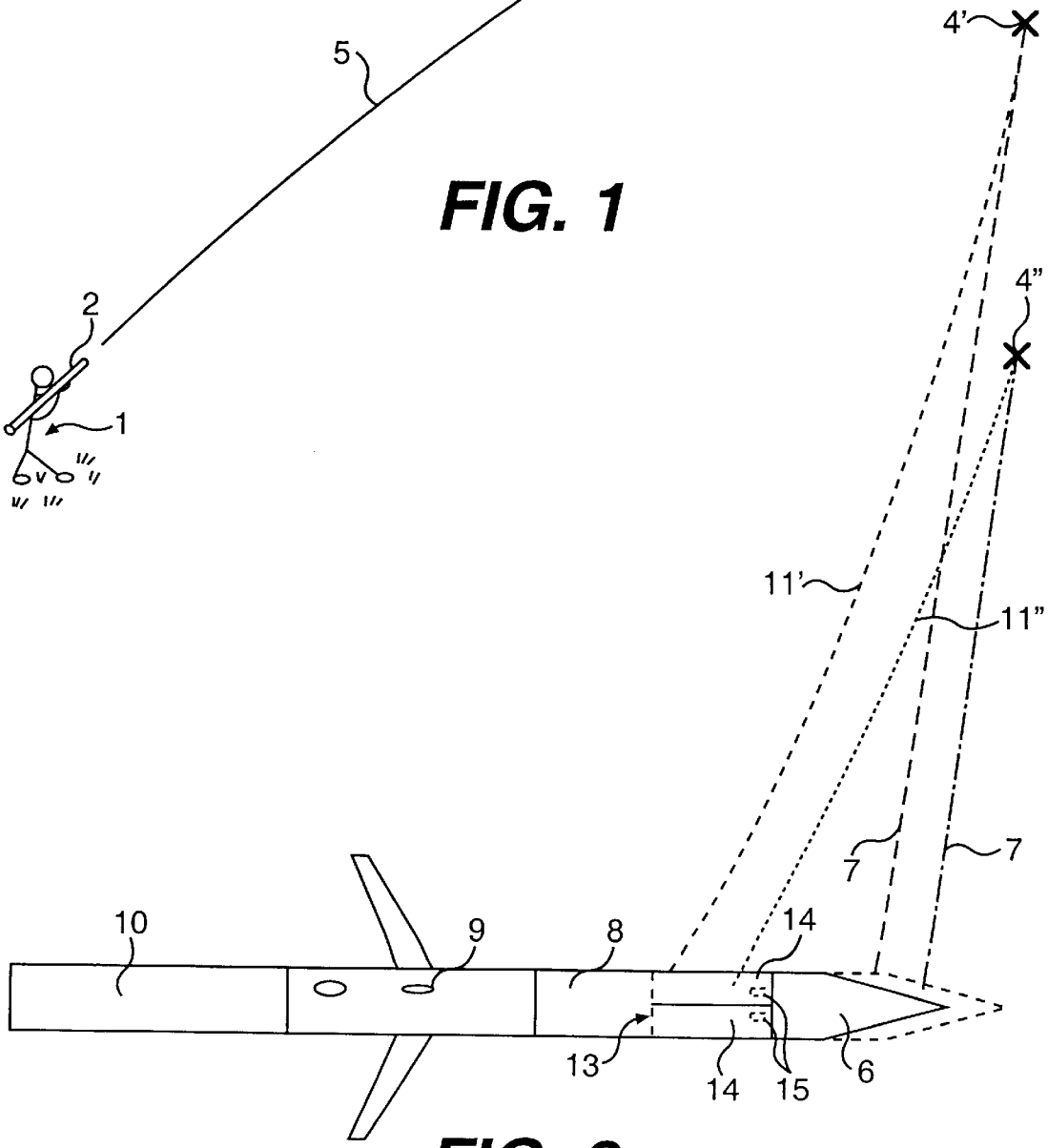
FIG. 2 shows the main parts of the projectile used in connection with the invention.

The projectile 3 shown in FIG. 2 comprises, in its forward part, the previously mentioned proximity fuse 6 with associated electronics which can include a programmable microprocessor and, immediately behind the latter, the active charge 8, a main drive motor 9, and a starter booster 10. The proximity fuse 6 can, for example, be a so-called optronic laser proximity fuse, an IR proximity fuse, or a proximity fuse of another basic type. A precondition for the proximity fuse in question is that it must have one to four concentrated search beams distributed evenly around the circumference of the projectile and with a very narrowly limited extent transverse to the search direction.

FIG. 2 also indicates two different positions of the target 4 (4' and 4") when the latter is struck by the search beam of the proximity fuse. These two positions lie at different distances from the projectile trajectory 5. When the proximity fuse 6 indicates targets at position 4', the active charge 8 is initiated, and a concentrated hail of splinters, formed on detonation of the active charge, is thrown towards the target along the trajectory 11' which shows the center line of the hail of splinters.

To begin with, the hail of splinters has a movement slightly obliquely forward relative to the direction of movement of the projectile but, as the component of movement in the trajectory direction is decelerated by the wind in the atmosphere, the direction of movement of the hail of splinters will become ever more radial the further the hail of shot has travelled away from the projectile. This has been illustrated in FIG. 2 by means of the target position 4" and splinter scatter 11".

The projectile may be provided with a casing 13. The casing 13 may at least partially adjoin the explosive. The casing 13 may include a plurality of splinter plates 14 that form splinters upon detonation of the explosive charge. The splinter plates 14 may be made of steel and/or heavy metal splinters and joining material.

To initiate detonation of the explosive charge, the projectile may include at least one initiation charge 15. The at least one initiation charge 15 is connected to and initiated by the proximity fuse. The at least one initiation charge 15 is positioned to result in the dynamic splinter scattering directions of the splinter plates 14 to pass a point along a maximum range of the proximity fuse where the proximity fuse has detected a target. That is, the real splinter scattering will take into account the fact that the effect of air and gravity on a hail of splinters will cause the splinters to deviate from a straight trajectory.

The proximity fuse may be designed with two identical search arms lying very close to each other. Different detections from both of the search arms are regarded as an indication of a target toward which the projectile has been directed is situated at a combatable distance, whereupon the explosive charge of the projectile is initiated. On the other hand, detections that are identical in terms of time and reading from both search arms are regarded as an indication of ground contact, water or cloud indication, or other error indication.

Figure 3:
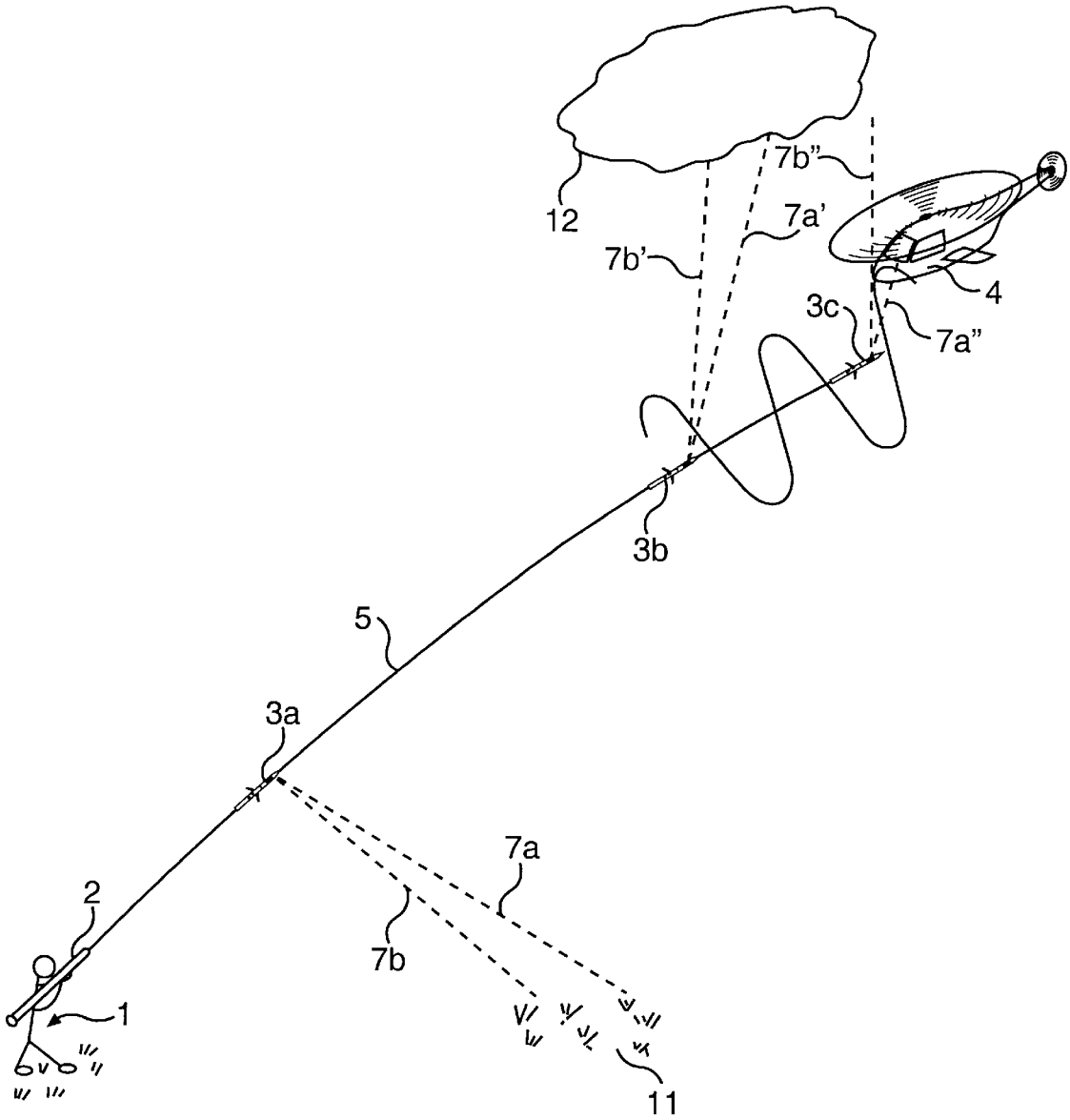
FIG. 3 represents an embodiment of the invention that includes search directions.

FIG. 3 illustrates an embodiment where the proximity fuse includes search directions. In the embodiment shown in FIG. 3, when the projectile is in position 3*a*, the two search arms 7*a* and 7*b* hit the ground 11. In this position, the proximity fuse will indicate an error and the explosive charge will not be initiated. The same result is obtained when the projectile is in position 3*b*, where the search arms 7*a'* and 7*b'* hit a cloud 12.

However, when in position 3*c*, the search beam 7*b"* will miss the target and the other search arm 7*a"* will hit the target, the helicopter 4. As a result, the explosive charge will be initiated and splinters of the explosive charge scattered in the direction of the target.

I claim:

1. A method for combating airborne targets, comprising;

launching a projectile in a trajectory direction toward an airborne target, the projectile including an explosive charge and a proximity fuse and rotating about its longitudinal axis;

searching with the proximity fuse in at least one search direction for the target, two closely associated search arms being directed in the at least one search direction, the search arms being in the vicinity of each other and oriented narrowly toward a side of the projectile at an angle of about 15 degrees to about 90 degrees with the trajectory direction of the projectile;

initiating detonation of the explosive charge upon indication of a target by only one of the search arms of the proximity fuse, and not initiating detonation of the explosive charge upon indication of a target by both of the search arms; and controlling splinter formation to scatter a concentrated hail of splinters in a direction toward the target.

2. The method according to claim 1, wherein controlling the splinter formation comprises providing the projectile with a casing that scatters splinters in at least one direction upon detonation of the explosive charge and coordinating the at least one search direction of the proximity fuse and the at least one direction of scattering of the casing.

3. The method according to claim 2, further comprising providing the casing with a number of splinter plates corresponding to a number of directions about the circumference of the projectile that the proximity fuse searches.

4. The method according to claim 2, wherein the proximity fuse searches in four directions evenly distributed about the circumference of the projectile.

5. The method according to claim 4, further comprising providing the casing with a number of splinter plates corresponding to a number of directions about the circumference of the projectile that the proximity fuse searches.

6. The method according to claim 1, wherein the proximity fuse searches in four directions evenly distributed about the circumference of the projectile.

7. The method according to claim 6, further comprising:

providing the casing with a number of splinter plates corresponding to a number of directions about the circumference of the projectile that the proximity fuse searches.

8. The method according to claim 6, further comprising:

coordinating arrangement of the splinter plates with the four search directions of the proximity fuse with respect to splinter-scattering directions of the splinter plates.

9. The method according to claim 1, further comprising:

providing the explosive charge with at least one initiation charge connected to and initiated by the proximity fuse; and positioning the at least one initiation charge such that the splinters will be directed where the proximity fuse has detected a target, taking into account gravity and air friction.

10. The method according to claim 1, further comprising:

providing the projectile with a microprocessor connected to the proximity fuse; and programming the microprocessor to initiate the explosive charge.

11. The method according to claim 1, further comprising:

providing the projectile with its own drive engine.

12. The method according to claim 1, wherein detonation is not initiated when a target is indicated by both search arms upon detection by the proximity fuse of ground, water, or cloud.

13. The method according to claim 1, wherein the closely associated search arms diverge from each other by one degree to a few degrees.

14. A device for combating airborne targets, comprising:

a projectile for firing in a trajectory toward a target, the projectile including a casing and rotating about its longitudinal axis during travel;

an explosive charge carried in the projectile, the projectile directing a concentrated hail of splinters toward a target upon detonation of the explosive charge;

a proximity fuse provided on the projectile, the proximity fuse searching in at least one search direction for the target, two closely associated search arms being directed in the at least one search direction, the search arms being in the vicinity of each other and oriented narrowly toward a side of the projectile at an angle of about 15 degrees to about 90 degrees with the trajectory direction of the projectile, the proximity fuse not initiating detonation of the explosive charge upon indication of a target by both of the search arms, the proximity fuse initiating detonation of the explosive charge upon indication of a target by only one of the search arms of the proximity fuse.

15. The device according to claim 14, wherein the projectile casing scatters splinters in at least one direction upon detonation of the explosive charge and the at least one search direction of the proximity fuse and the at least one direction of scattering are coordinated.

16. The device according to claim 14, wherein the casing comprises steel or heavy metal and the splinters comprise constituent parts of the casing.

17. The device according to claim 14, wherein the casing at least partially adjoins the explosive charge.

18. The device according to claim 14, wherein the casing comprises a number of splinter plates corresponding to a number of directions about the circumference of the projectile that the proximity fuse searches.

19. The device according to claim 14, wherein the proximity fuse searches in four directions evenly distributed about the circumference of the projectile.

20. The device according to claim 18, wherein the casing comprises a plurality of splinter plates corresponding to the four directions about the circumference of the projectile that the proximity fuse searches.

21. The device according to claim 19, wherein arrangement of the splinter plates is coordinated with the four search directions of the proximity fuse with respect to dynamic splinter-scattering directions of the splinter plates.

22. The device according to claim 14, further comprising:

at least one initiation charge connected to and initiated by the proximity fuse, the at least one initiation charge positioned such that the splinters pass the point where the proximity fuse has detected a target, taking into account gravity and air friction.

23. The device according to claim 14, further comprising:

a microprocessor connected to the proximity fuse, the microprocessor being programmed to initiate the explosive charge.

24. The device according to claim 14, further comprising:

a drive engine.

25. The device according to claim 14, wherein the proximity fuse does not initiate detonation of the explosive charge when a target is indicated by both search arms upon detection by the proximity fuse of ground, water, or cloud.

26. The device according to claim 14, wherein the proximity fuse is an optronic laser proximity fuse.

27. The device according to claim 14, wherein the search arms diverge from each other by one degree to a few degrees.

* * * * *